United States Patent [19]

DuGrenier et al.

[11] Patent Number: 4,815,483

[45] Date of Patent: Mar. 28, 1989

[54] COSMETIC PACKAGE WITH STACKED ROTATABLE TRAYS

[76] Inventors: Robert DuGrenier, 171 Duane St., New York, N.Y. 10013; Maria Kuluris, 3249 W. 127th St., Cleveland, Ohio 44111

[21] Appl. No.: 40,502

[22] Filed: Apr. 20, 1987

[51] Int. Cl.[4] ..... A45D 33/00

[52] U.S. Cl. ..... 132/295; 132/314; 211/129; 211/13; 220/4 D; 206/229

[58] Field of Search ..... 132/82 R, 82 C, 82 D, 132/82 E, 82 F, 83 R, 83 C, 83 F, 83 G, 79 R, 79 D, 79 F, 79 G; 206/501, 821, 581, 229, 362, 823; 220/4 D; 312/120, 123, 136; 211/129, 13, 163, 110

[56] References Cited

U.S. PATENT DOCUMENTS

| | | | |
|---|---|---|---|
| RE28,752 | 3/1976 | Balamuth et al. | 318/116 |
| DE168,727 | 2/1953 | Barnett et al. | D7/21 |
| 1,460,950 | 7/1923 | Denney | 132/83 R |
| 1,522,312 | 1/1925 | Marcus | 132/83 R |
| 1,526,485 | 2/1925 | Morrison | 132/83 R |
| 1,600,830 | 9/1926 | Lewis | 312/227 |
| 1,821,741 | 9/1931 | Dalton | 132/79 F |
| 3,441,033 | 4/1969 | Flax | 132/82 R |
| 3,482,728 | 12/1969 | Flax | 220/20 |
| 3,498,471 | 3/1970 | Dirkx | 211/131 |
| 4,155,477 | 5/1979 | Foster | 220/4 D |
| 4,560,078 | 12/1985 | Dubuisson | 220/4 D |

FOREIGN PATENT DOCUMENTS

| | | | |
|---|---|---|---|
| 0489920 | 1/1953 | Canada | 132/79 G |
| 0101346 | 3/1965 | Denmark | 220/4 D |
| 0855743 | 3/1940 | France | 132/82 F |
| 1296732 | 5/1962 | France | 132/79 F |

*Primary Examiner*—Gene Mancene

*Attorney, Agent, or Firm*—Nolte, Nolte and Hunter

[57] ABSTRACT

A cosmetic package has matching shallow trays of cosmetics individually coupled closely one above the other to an upstanding cylindrical post for relative rotation of the trays about the post axis in planes normal to the axis. A rectangular solid block forms a stable base that provides support for the post and for a cosmetic applicator receptable alongside which the trays are disposed when they have an aligned mutually stacked relation overlying the base. The base also supports a removable cover enclosing the tray stack, the post and the receptacle with applicators. The tray coupling to the post permits removal of any selected tray from the package for replacement or replenishment merely by displacing the tray a given angular distance from its aligned mutually stacked relation overlying the base. Such coupling is by way of a partially cylindrical cut-out in the rim of the tray, the cut-out being open along the height of the outer edge of the rim to permit lateral ingress and egress of the post. A snap-fit is obtained when the breadth of the outer edge opening is smaller than the post diameter and the tray material is resilient. A keyed-fit is obtained when the opening breadth is even smaller and opposed parallel flats are provided on the post surface with a spacing keyed to the opening breadth. The angular orientation of the flats about the post axis determines the angular position required of a tray to permit its removal for replacement or replenishment.

12 Claims, 3 Drawing Sheets

COSMETIC PACKAGE WITH STACKED ROTATABLE TRAYS

BACKGROUND OF THE INVENTION

This invention relates to cosmetic packages of the kind having a plurality of shallow cosmetic trays arranged for relative rotation into and out of mutually stacked positions about a common axis.

Such cosmetic packages have been provided heretofore wherein each shallow tray contains one or more solid cosmetics, such as discs, wafers, or cakes of face powder, lipstick, mascara and eye shadow, which are exposed when the open tops of the trays are uncovered. In U.S. Pat. No. 3,441,033, issued Apr. 29, 1969, for example, each cosmetic-containing shallow tray of the disclosed package is pivotally coupled at a peripheral zone thereof to an elongated cylindrical post for relative rotation about the post axis. The contents of the top tray are exposed by swinging a swivel-mounted lip up about an axis perpendicular to the post axis from a closed position at which the lid covers the open top of the top tray, whereas the contents of the intermediate and bottom trays are rendered accessible by the relative rotational movement thereof. As the post extends through bores in peripherally-located lugs of the trays, the trays are captured by the post; and, when their contents are spent, they are not replaceable by filled trays without first taking the package completely apart. Thus, as a practical necessity, the existing trays must be replenished in situ with solid cosmetic refills specially shaped to fit tray wells occupied by spent cosmetic discs, wafers or cakes.

The cosmetic package disclosed in the above-mentioned U.S. Pat. No. 3,441,033 is moreover inherently unstable, owing to the absence of any support for the elongated cylindrical post from which the trays are cantilevered for relative angular displacement. Thus, with the bottom tray resting on a vanity table or other level supporting surface, the package will topple or lean over when there is any appreciable angular displacement of the top tray or intermediate tray relative to the bottom tray. One solution to this problem, in a tray set similarly having to be taken apart for tray replacement, has been described in U.S. Pat. No. 3,498,471, issued Mar. 3, 1970, and it involves removal of the top tray and interfitting it with the bottom tray to provide a tray-formed stabilized base for the cantilevered trays above. Once this is done, however, the top and bottom trays become non-rotatable and there can be no mutually stacked position of all the trays.

SUMMARY OF THE INVENTION

An object of the invention is to avoid the foregoing drawbacks.

Another object of the invention is to provide a cosmetic package wherein each tray of a plurality of trays relatively rotatable into and out of mutually stacked positions about a common axis is readily removable for replacement or replenishment with minimum disturbance of each other tray.

Another object of the invention is to provide a cosmetic package satisfying the foregoing objects and wherein the spatial orientation of the common axis is stabilized so as to be unaffected by the relative rotation of each tray about the axis into and out of the mutually stacked positions of the plurality of trays.

Hence, in a cosmetic package comprising a plurality of shallow trays for receiving cosmetics, the trays having the same dimensions and configurations in plan and being pivotally coupled at corresponding respective peripheral zones thereof to an elongated cylindrical post for relative rotation into and out of mutually stacked positions about the post axis, there is provided in accordance with the invention the improvement wherein the elongated cylindrical post is secured at one end thereof to a stable base so as to extend vertically upward therefrom when the base is disposed on a lever supporting surface, and wherein each tray comprises an open container with a flat bottom and a low rim of uniform height, the peripheral coupling zone of each tray being located in an enlarged width portion of the rim having a partially cylindrical cut-out coextensive with the height of the rim and in close interfitting relationship with the cylindrical post to provide the pivotal coupling of the tray, the cut-out being open along the outer edge of the rim to permit selective movement of the tray in a direction normal to and away from the post axis to uncouple the tray from the post, whereby the tray may be removed for replacement or replenishment while the other trays remain pivotally coupled to the post.

Preferably, the trays, in one of their mutually stacked positions, overlie a first areal portion of the top of the base adjacent a second areal portion thereof which an upstanding receptacle for cosmetic applicators overlies, the receptacle having an apertured top for receiving elongated handles for the applicators and holding the handles in substantial parallelism with the post axis.

Each tray is preferably adapted to provide a snap-fit of its partially cylindrical cut-out into the close interfitting relationship with the cylindrical post.

A removable rigid cover is preferably provided for placement enclosingly over the upstanding receptacle, including cosmetic applicators held therein, and simultaneously over the trays in a mutually stacked position on the base, the cover when so placed having its open bottom end resting on a peripheral third areal portion of the top of the base with walls of the cover being aligned with corresponding walls of the base.

DETAILED DESCRIPTION OF THE INVENTION

Figure 1:
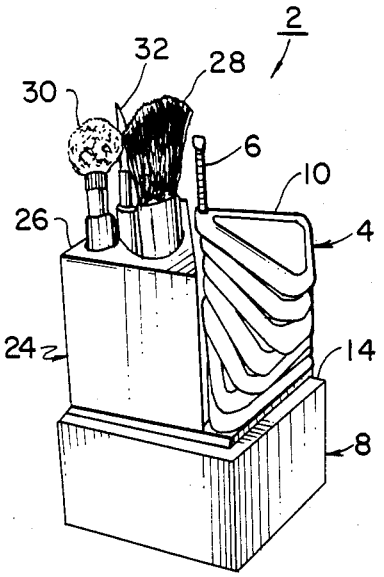
FIG. 1 is a perspective view of a preferred embodiment of the cosmetic package showing the base, the post, the cosmetic trays in aligned stacked relation and the applicator receptacle holding an assortment of cosmetic applicators.

Referring to FIG. 1, the cosmetic package 2 includes a plurality of shallow trays 4, which may number more or less than the seven actually shown. Each tray 4 comprises an open container with a flat bottom and a low rim of uniform height, and all have the same dimensions and plan configurations.

An elongated cylindrical post 6 is secured at one of its ends to a stable base 8 so as to extend vertically upward when base 8 is disposed on a level supporting surface. The low rim of each tray 4 includes an enlarged width portion 10 having a partially cylindrical cut-out 12 coextensive with the height of the rim and in close interfitting relationship with cylindrical post 6 to pivotally couple the tray to the post for rotation about the post axis. The trays 4 are accordingly rotatable relative to one another into and out of mutually stacked positions about the post axis, one such position being shown in FIG. 1 wherein the trays are in aligned stacked relation overlying an areal portion of the top 14 of base 8.

Figure 5:
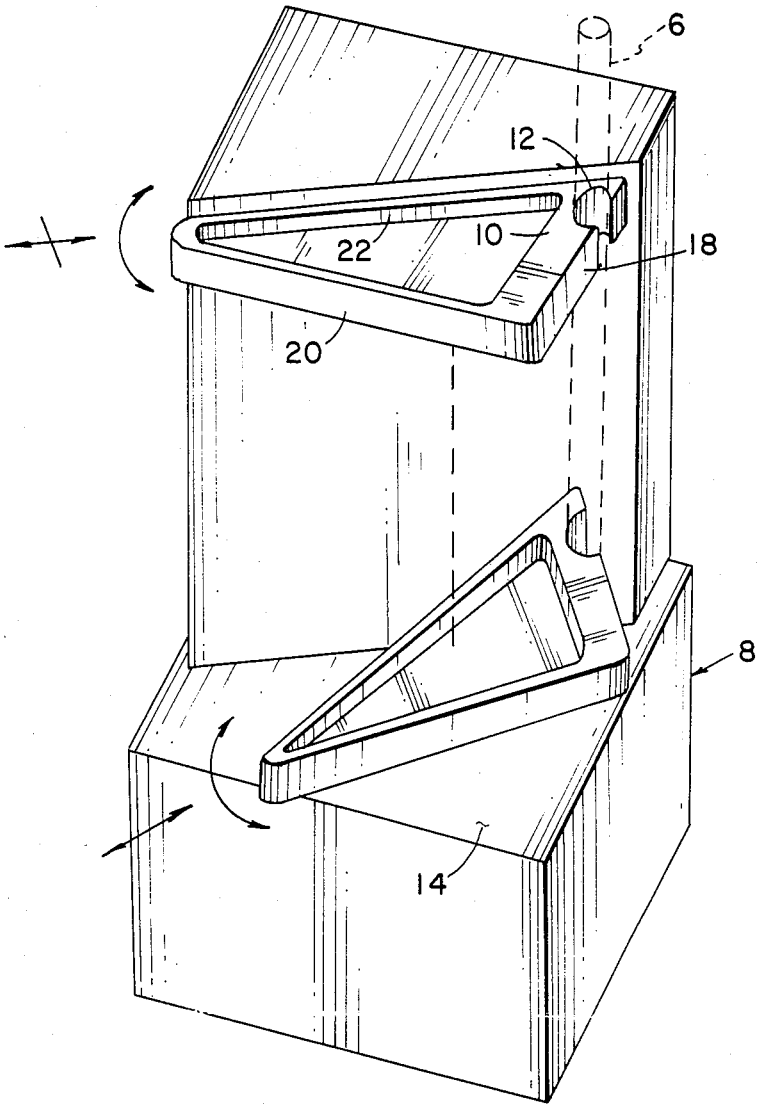
FIG. 5 illustrates a preferred form of the rim-located cut-out of each tray and schematically depicts the coupling/uncoupling function of the cut-out relative to the post.

A preferred form of partially cylindrical cut-out 12 is shown in FIG. 5 as a cylindrical trough having its cylinder axis normal to the flat bottom of tray 4 and spaced slightly inwardly of the outer edge of enlarged width rim portion 10 of tray 4, so that the breadth of the trough mouth opening at the outer edge is slightly smaller than the cylinder diameter of the trough and the complementary diameter of cylindrical post 6. If desired, the cylinder axis of the trough may be located further inwardly; and, without changing the breadth of the mouth opening, cut-out 12 may further be formed with a parallel-walled channel of like breadth extending from the inwardly displaced trough mouth to the outer edge. In either case, provided that the tray material is suitable resilient, such as is "Nylon 6", each tray 4 will thereby be adapted to provide a snap-fit of its partially cylindrical cut-out 12 into the aforementioned close interfitting relationship with cylindrical post 6. Alternatively, the snap-fit feature may be dispensed with by forming the cylindrical trough of cut-out 12 with no more than a semi-circular cross-section. While this may be feasible in some instances, the snap-fit feature will generally be preferable thereover owing to the close interfitting relationship of cut-out 12 with post 6 that is maintained in consequence of its use, yet conveiently surmounted for deliberate uncoupling of any selected tray 4.

Figure 6:
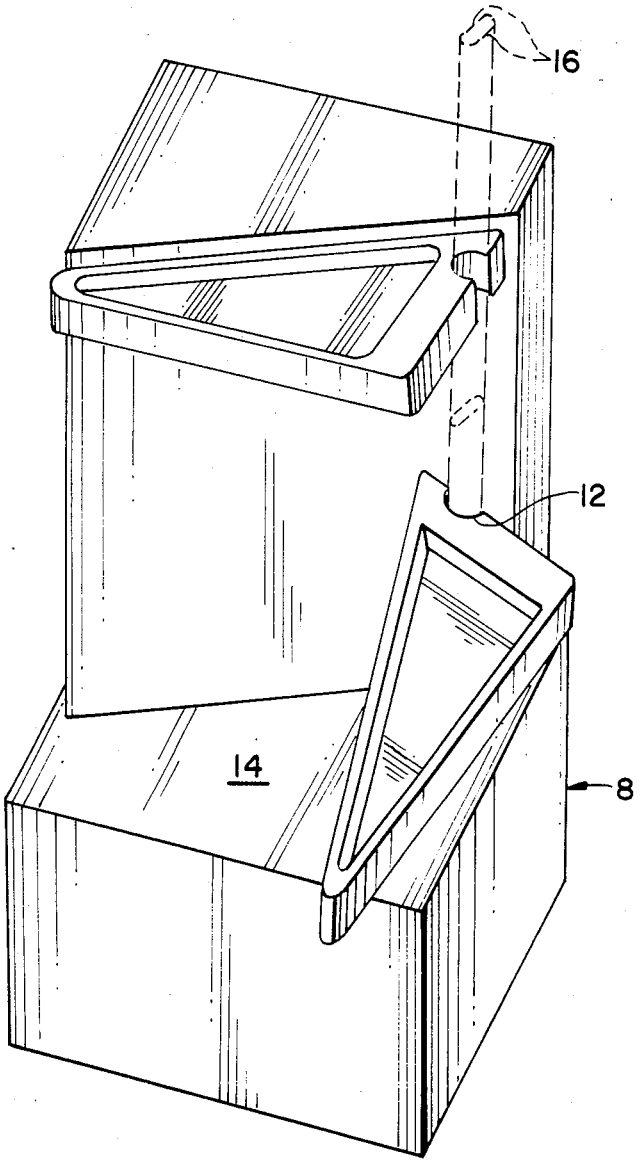
FIG. 6 is a similar in nature to FIG. 5, but illustrates modified forms, respectively, of the cut-out and post which render the uncoupling and recoupling of a tray possible only at a selected angular position of the tray about the post axis.

In another instance where, in addition to the above advantages of the snap-fit feature, it is desired to render the deliberate uncoupling of any selected tray 4 possible only when the tray has been rotated about the axis of cylindrical post 6 to a position substantially angularly displaced, say by 90°, from a position overlying base 8, this desire may be realized, as shown in FIG. 6, by forming an opposed pair of parallel flats 16 on the cylindrical surface of post 6 throughout its length and spaced from one another by a distance nearly equal to the breadth of the mouth opening of cut-out 12. Thus, with post 6 fixed to base 8 and flats 16 appropriately oriented, a tray 4 in its 90° angularly displaced position can be freely moved in a direction normal to the post axis for engagement and disengagement of cut-out 12 with post 6. Engagement provides pivotal coupling of tray 4 for rotation about the post axis by way of the close interfitting relationship of the partially cylindrical cut-out 12 with the opposed cylindrical surfaces of complementary diameter subtended by the parallel pair of flats 16 on post 6. In FIG. 6, as in FIG. 5, cut-out 12 is shown as a cylindrical trough having its cylinder axis normal to the flat bottom of each tray 4. In FIG. 6, however, this axis is shown spaced further inwardly of the edge of enlarged width rim portion 10 of tray 4, thereby to provide more cylindrical surface area in the trough for cooperation with the opposed cylindrical surfaces of post 6.

Figure 4:
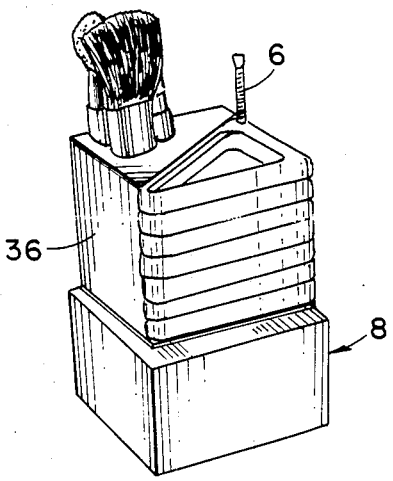
FIGS. 3 and 4 are perspective views similar to that of FIG. 1, but from different aspects and with the cosmetic trays progressively rotated about the post axis out of their aligned stacked relation from top to bottom and vice-versa, respectively.
Figure 3:
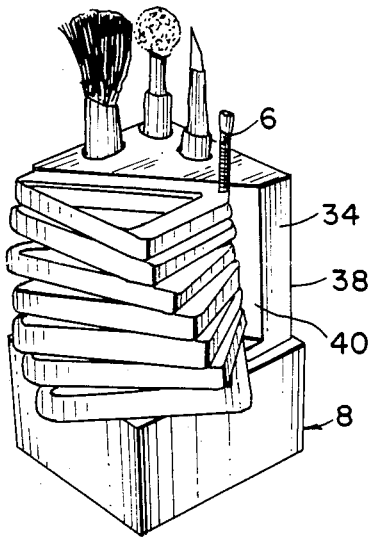

The relative angular displaceability of trays 4 about the axis of post 6 is further illustrated in FIGS. 3 and 4. In FIG. 3, trays 4 are progresively angularly displaced relative to one another from the top to the bottom of the stack, the uppermost tray being shown in the same position at which it is shown in FIG. 1, whereas the lowermost tray is shown angularly displaced approximately 45° from its FIG. 1 position. FIG. 4 shows trays 4 progressively angularly displaced relative to one another from the bottom to the top of the stack, the lowermost tray having its FIG. 1 position, with the uppermost tray being angularly displaced approximately 45° from the position shown therefor in FIG. 1.

In order to gain access to the cosmetic in any selected tray, except the uppermost tray, one needs merely to rotate the selected tray about the axis of post 6 from its FIG. 1 stacked aligned relationship with the other trays until its contents are readily accessible.

Referring further to FIGS. 3 and 4 in conjunction with FIG. 1, stable base 8 is shown as a rectangular block, such block preferably being a solid mass for enhanced stability. Each tray 4 is moreover shown as having a right triangular configuration in plan, with enlarged width portion 10 of the tray rim being coextensive in length with a shorter one 18 of the mutually perpendicular sides 18 and 20 of the right triangular configuration. Cut-out 12 of each tray 4 is proximal the intersection of shorter side 18 with the hypotenuse side 22 of the tray configuration.

The areal portion of base top 14 which underlies trays 4 in their FIG. 1 aligned stacked relation is adjacent a second areal portion of base top 14 which underlies an upstanding cosmetic applicator receptacle 24 having a trapezoidal configuration in plan. Receptacle 24 is provided with an apertured top 26 for receiving the elongated handles of conventional cosmetc applicators, such applicators being illustrated as a blush brush 28, an eye shadow sponge 30 and an eyeliner or lip brush 32, their handles being held in substantial parallelism with the axis of cylindrical post 6. Receptacle 24 is of a height substantially matching the stacked height of trays 4, whereby apertured top 26 is substantially level with the rim top of the uppermost tray in the stack. Apertured top 26 is joined at its periphery to base top 14 by four planar side walls 34, 36, 38 and 40 of receptacle 24. Two side walls 34 and 36 of receptacle 24 are parallel to one another and mutually perpendicular to third side wall 38. Fourth side wall 40 of receptacle 24 is in parallel adjacency to hypotenuse side 22 of each tray configuration when trays 4 are in their FIG. 1 aligned stacked relation overlying base top 14.

Figure 2:
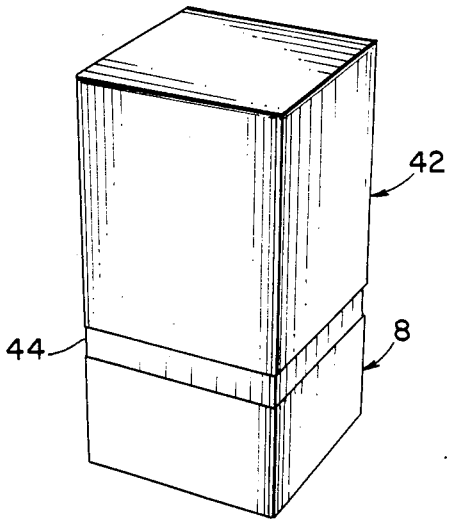
FIG. 2 is a perspective view of the FIG. 1 embodiment as it appears with the addition of a base-supported cover enclosing the post, the trays, the receptable and the applicators.

The FIG. 1 aligned stacked relation of trays 4 must exist for placement enclosingly of a removable rigid cover 42 (FIG. 2) over the stacked trays and upstanding receptacle 24, including applicators 28, 30 and 32 held in the receptacle. FIG. 2 shows cover 42 in place. When so placed, cover 42 has its open bottom end 44 resting on a peripheral areal portion of top 14 of base 8, with side walls of cover 42 being aligned with corresponding side walls of base 8. Thus, the addition of cover 42 to cosmetic package 2 results in a geometrically attractive assembly of right rectangular prismatic shape, as seen in FIG. 2, quite apart from the resulting protection afforded by cover 42 in respect of maintaining trays 4 and applicators 28, 30 and 32 in place during transit and at any spatial orientation of cosmetic package 2.

The present invention is advantageously embodied in miniature cosmetic packages; and, when so embodied, the assembly shown in FIG. 2 may, for example, have a height of 2.875 inches and a width on each side of 1.625 inches. With such dimensions, the cosmetic package requires only 2.64 square inches of base supporting area on a vanity table and only 3 cubic inches of carrying space within a ladies shoulder bag.

The pivotal coupling of trays 4 ensures that access can be conveniently had to the cosmetics in all the trays, not just the cosmetic in the constantly exposed uppermost tray. The nature of the pivotal coupling of trays 4 to post 6 ensures that any selected one of trays 4 may readily be uncoupled for replacement or replenishment without disruption of any kind to the pivotal coupling of the remaining ones of trays 4.

What is claimed is:

1. In a cosmetic package comprising a plurality of shallow trays for receiving cosmetics, said trays having the same dimensions and configuration in plan and being pivotally coupled at corresponding respective peripheral zones thereof to an elongated cylindrical post for relative rotation into and out of mutually stacked positions about the post axis, the improvement wherein:

(a) said elongated cylindrical post is secured at one end thereof to a stable base so as to extend vertically upward therefrom when said base is disposed on a level supporting surface; and wherein (b) each tray comprises an open container with a flat bottom and a low rim of uniform height, said peripheral zone of each tray being located in an enlarged width portion of said rim having a partially cylindrical cut-out coextensive with said height of said rim and in close interfitting relationship with said cylindrical post to provide said pivotal coupling of the tray, said cut-out being open along the outer end of said rim to permit selective movement of the tray in a direction normal to and away from said post axis to uncouple the tray from said post, whereby the tray may be removed for replacement or replenishment while the other trays remain pivotally coupled to said post.

2. A cosmetic package according to claim 1, wherein said trays, in one of their mutually stacked positions, overlie a first areal portion of the top of said base adjacent a second areal portion thereof which an upstanding receptacle for cosmetic applicators overlies, said receptacle having an apertured top for receiving and holding elongated handles of said applicators in substantial parallelism with said post axis.

3. A cosmetic package according to claim 2, wherein each tray is adapted to provide a snap-fit of its said partially cylindrical cut-out into said close interfitting relationship with said cylindrical post.

4. A cosmetic package according to claim 3, wherein a removable rigid cover is provided for enclosing placement over said upstanding receptacle, including cosmetic applicators held therein, and simultaneously over said trays in said one of their mutually stacked positions; and wherein said cover, when so placed, has its open bottom end resting on a peripheral third areal portion of said top of base with side walls of said cover being aligned with corresponding side walls of said base.

5. A cosmetic package according to claim 2, wherein a removable rigid cover is provided for enclosing placement over said upstanding receptacle, including cosmetic applicators held therein, and simultaneously over said trays in said one of their mutually stacked positions; and wherein said cover, when so placed, has its open bottom end resting on a peripheral third areal portion of said top of said base with side walls of said cover being aligned with corresponding side walls of said base.

6. A cosmetic package according to claim 5, wherein said base comprises a solid rectangular block.

7. A cosmetic package according to claim 6, wherein said configuration in plan of said trays is right triangular; and wherein said enlarged width portion of said rim of each tray is coextensive in length with a shorter one of the mutually perpendicular sides of said right triangular configuration, said cut-out being proximal the intersection of said shorter side with the hypotenuse of said right triangular configuration.

8. A cosmetic package according to claim 7, wherein said apertured top of said upstanding receptacle is joined at its periphery to said top of the base by four planar side walls, two side walls of which are parallel to one another and mutually perpendicular to a third side wall, whereby said receptacle has a trapezoidal configuration in plan; and wherein said hypotenuse of each tray configuration is parallel to the fourth side wall of said receptacle when said trays are disposed in said one of their mutually stacked positions overlying said first areal portion of said top of the base.

9. A cosmetic package according to claim 2, wherein said partially cylindrical cut-out of said tray is formed as a cylindrical trough, the cylinder axis of which is normal to said flat bottom of said tray and spaced inwardly of said outer edge of said rim, so that the breadth of the trough mouth opening at said outer edge is smaller than the cylinder diameter of said trough and the complementary diameter of said cylindrical post; and wherein an opposed pair of parallel flats are provided on the surface of said cylindrical post throughout its length, said opposed flats being so oriented on said post and so spaced from one another as to permit free lateral passage of said post through said trough mouth opening only when said tray is angularly displaced at least 90° about said post axis from said one of the mutually stacked tray positions overlying said first areal portion of said top of said base.

10. A cosmetic package according to claim 1, wherein each tray is adapted to provide a snap-fit of its said partially cylindrical cut-out into said close interfitting relationship with said cylindrical post.

11. A cosmetic package according to claim 10, wherein said snap-fit of said partially cylindrical cut-out of each tray into said close interfitting relationship with said cylindrical post is obtained by providing said outer rim edge opening of said cut-out with a breadth slightly smaller than the post diameter and by forming the tray of resilient material to enable enlargement and restoration of said opening breadth in response, respectively, to pressure exerted on, and released from, the sides of said opening by said post in the course of said selective movement of the tray in a direction normal to and away from said post axis.

12. A cosmetic package according to claim 10, wherein said partially cylindrical cut-out said tray is formed as a cylindrical trough having its cylinder axis normal to said flat bottom of said tray and spaced inwardly of said outer edge of said rim, so that the breadth of the trough mouth opening at said outer edge is smaller than the cylinder diameter of said trough and the complementary diameter of said cylindrical post; and wherein said tray is formed of material resiliently yieldable to permit forcible lateral passage of said cylindrical post through said trough mouth opening into and out of said close fitting relationship with said cut-out.

* * * * *